US005176094A

United States Patent [19]

Gongwer

[11] Patent Number: 5,176,094

[45] Date of Patent: Jan. 5, 1993

[54] WATERCRAFT PROPULSION SYSTEM

[76] Inventor: Calvin A. Gongwer, 19017 E. Leadora Ave., Glendora, Calif. 91740

[21] Appl. No.: 795,664

[22] Filed: Nov. 21, 1991

Related U.S. Application Data

[60] Division of Ser. No. 401,139, Aug. 31, 1989, Pat. No. 5,127,857, which is a continuation of Ser. No. 213,944, Jun. 30, 1988, Pat. No. 4,887,540.

[51] Int. Cl.[5] ..... B63B 1/00

[52] U.S. Cl. ..... 114/61; 114/56

[58] Field of Search ..... 114/56, 61

[56] References Cited

U.S. PATENT DOCUMENTS 4,174,671 11/1979 Seidl ..... 114/61

4,348,972 9/1982 Parson ..... 114/61

*Primary Examiner*—Jesus D. Sotelo

*Attorney, Agent, or Firm*—Lyon & Lyon

[57] ABSTRACT

A propulsion system capable of more efficiently accomplishing all that the prior art propulsion systems can accomplish and additionally providing for manuevers that had hereto been unavailable with purely stern-driven craft through the use of a first and second devices for generating propulsion mounted at the rear of the craft to be driven. The two devices for propulsion are arranged one over the other so that the centerlines are substantially aligned vertically. A movable rudder is mounted substantially vertically at the rear of the craft paralle to the centerline of and in the effluent streams of said first and second propulsion devices. A fixed fin array is also mounted at the rear of the craft in the effluent streams of said first and second propulsion devices just forward of the rudder.

22 Claims, 5 Drawing Sheets

WATERCRAFT PROPULSION SYSTEM

This is a divisional of co-pending application Ser. No. 07/401,139, filed on Aug. 31, 1989, now U.S. Pat. No. 5,127,857 which is a continuation of U.S. patent application Ser. No. 07/213,944, filed on Jun. 30, 1988, now U.S. Pat. No. 4,887,540.

BACKGROUND

1. Field of the Invention

The field of the present invention is propulsion systems. More specifically the field of the invention is propulsion systems for watercraft.

2. The Prior Art

The propulsion systems employed by most watercraft today are mounted side-by-side. This results in the use of a large volume of space and requires very wide hulls at the stern. Additionally, the propulsion systems of current watercraft make it difficult for the craft to maintain high speeds in rough seas.

The design of a watercraft incorporating the present invention provides for remarkable rough-sea speed and weathering capabilities.

SUMMARY OF THE INVENTION

The unique arrangement of the components of the present invention is capable of more efficiently accomplishing all that the prior art propulsion systems can accomplish. Additionally, the present invention provides for manuevers that had hereto been unavailable with purely stern-driven craft. For example, the present invention allows a pure lateral force to be generated in a stern-driven marine vessel without the need for side thrusters.

These advantages are obtained through the use of a first and second means for generating propulsion mounted at the rear of the craft to be driven. The two means for propulsion are arranged one over the other so that the centerlines are substantially aligned vertically. A movable rudder is mounted substantially vertically at the rear of the craft parallel to the centerline of and in the effluent streams of said first and second propulsion means. A fixed fin array is also mounted at the rear of the craft in the effluent streams of said first and second propulsion means just forward of the rudder. Preferably the fixed fin array is comprised of a vertical fin and a first and second horizontal fin. For the best results the vertical fin is mounted essentially parallel to the rudder between the first and second propulsion means and the rudder. The first horizontal fin is mounted perpendicular to the rudder in the effluent stream of the first propulsion means while the second horizontal fin is mounted perpendicular to the rudder in the effluent stream of the second propulsion means.

In addition to the foregoing, other unique features of the invention have provided unexpected advantages when the propulsion system is utilized on an ocean going vessel. For example, when the over/under propulsion means arrangement is employed on a tri-hull blunt stern semi-submersible vessel having bow fins, extraordinary wave riding characteristics can be achieved.

Accordingly it is one object of the invention to provide a propulsion system capable of providing pure lateral thrust. Other and further objects and advantages of the various aspects of this invention appear hereinafter.

DETAILED DESCRIPTION OF THE PREFERRED EMBODIMENT

Figure 1:
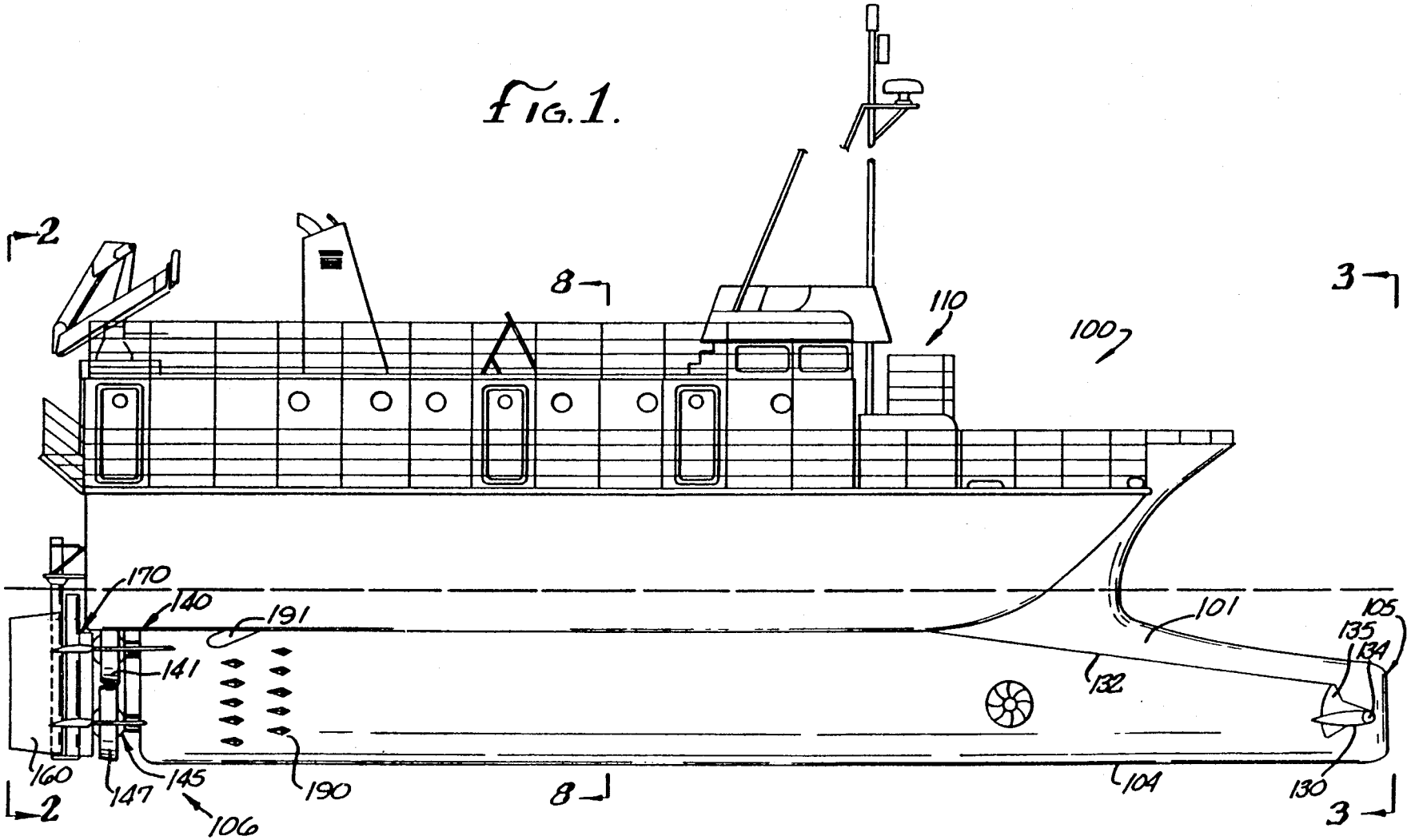
FIG. 1 is a side view of marine vessel incorporating the present invention.
Figure 2:
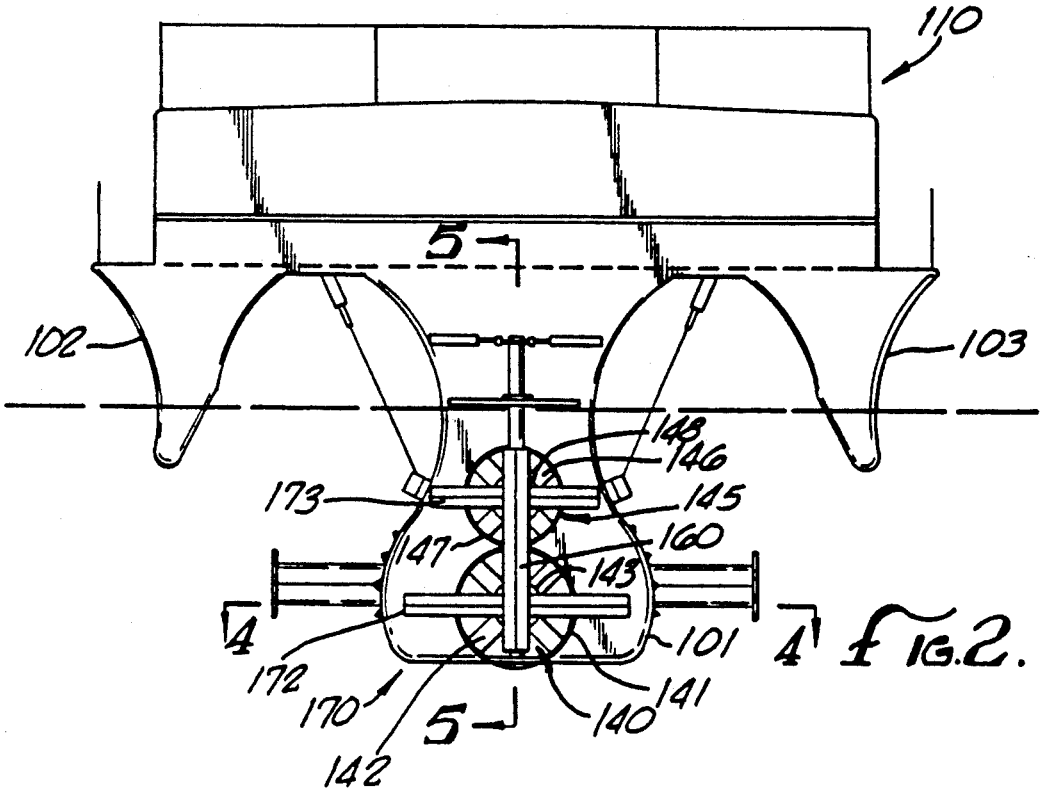
FIG. 2 is an aft end view of a marine vessel incorporating the present invention.
Figure 3:
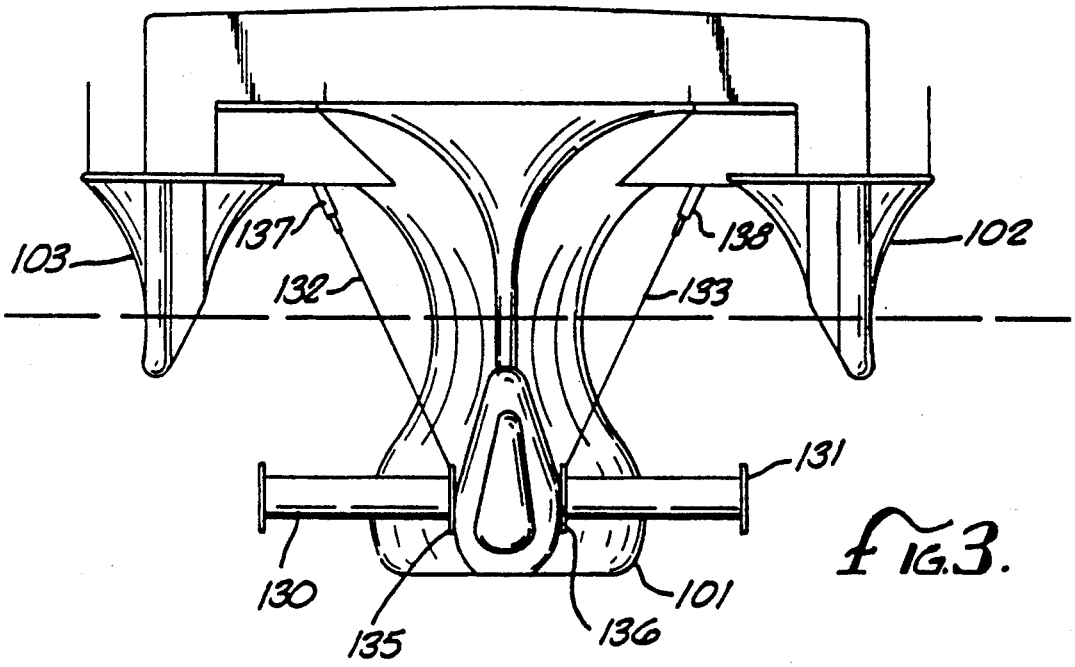
FIG. 3 is a bow end view of a marine vessel incorporating the present invention.
Figure 4:
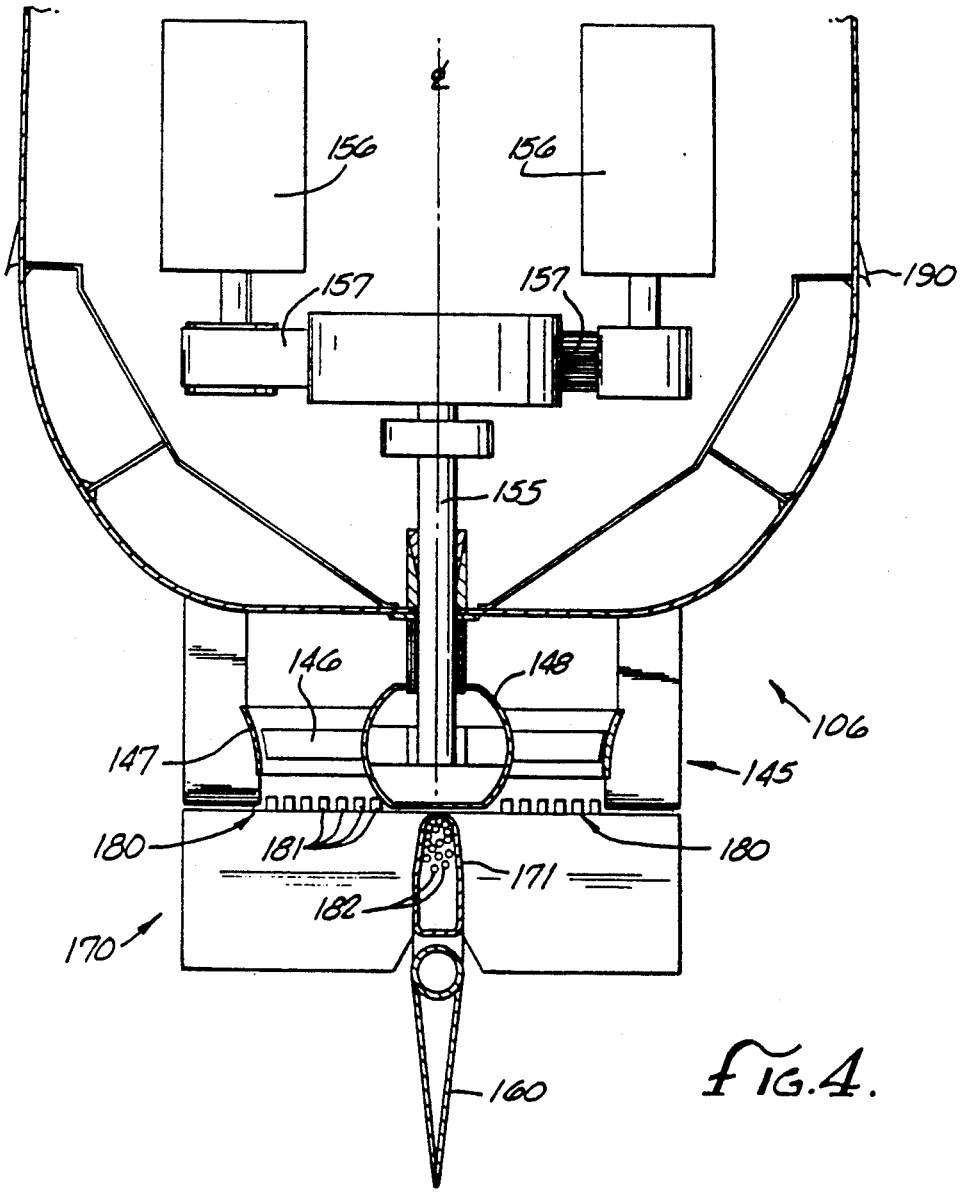
FIG. 4 is a cross section taken along plane 4—4 of FIG. 3.
Figure 8:
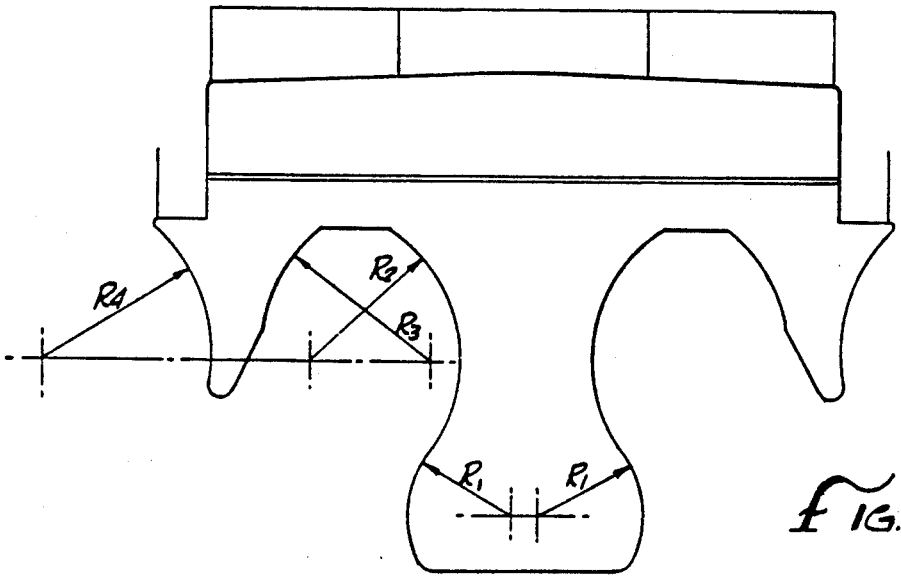
FIG. 8 is a cross section taken along plane 8—8 of FIG. 1.
Figure 5:
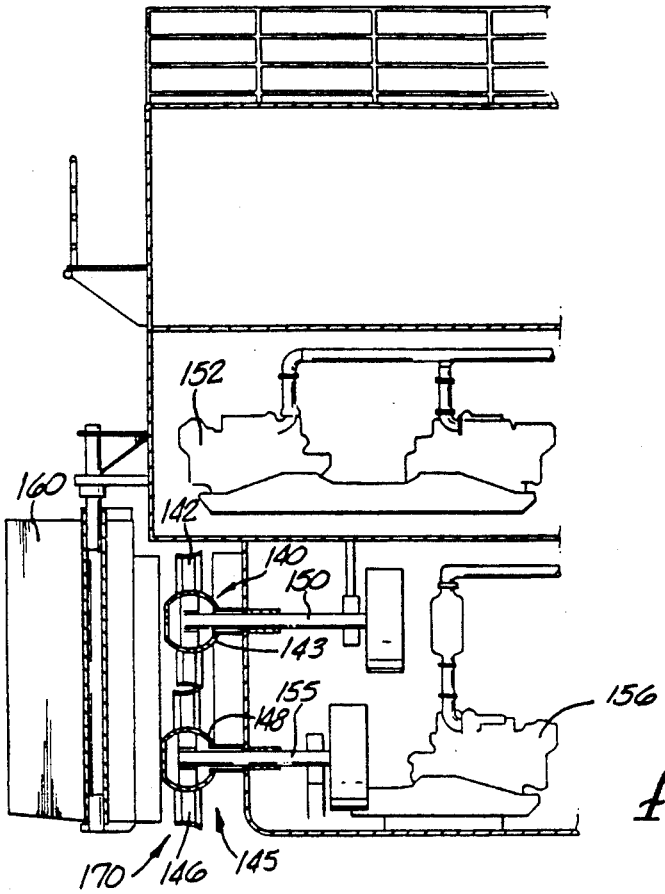
FIG. 5 is a cross section taken along plane 5—5 of FIG. 3.

FIG. 1 depicts a side view of a marine vessel 100 incorporating the preferred embodiment of the present invention. The vessel 100 has a unique tri-hull configuration that has incorporated the advantages and features of small water-plane area twin hull (SWATH) technology. The vessel 100 is comprised of a central hull 101, a port side sponson 102 and a starboard side sponson 103. The central hull 101 has a substantially flat bottom 104 which provides for ease of support in dry dock. The central hull 101 has double curved surfaces only at the bow 105 and the stern 106 which greatly simplifies design considerations and manufacturing. Further the central hull 101 and sponsons 102 and 103 have cross sectional contours comprised solely of circle arcs $R_1$ through $R_4$. The design of the hull and sponsons using only circle arc contours also simplifies layout and fabrication, adding to the substantial savings in manufacturing costs.

The center hull 101 and sponsons 102 and 103 are held together in rigid alignment by means of a deck house 110 of torsion box construction. The decks 111, deck house sides 112, and deckhouse transverse bulkheads 113 are all constructed of steel making a rigid reinforced box which provides the necessary support and bracing for the entire vessel. The torsion box construction technique of holding together the center hull 101 and sponsons 102 and 103 provides exceptional rigidity while keeping construction and material costs at a minimum.

Figure 6:
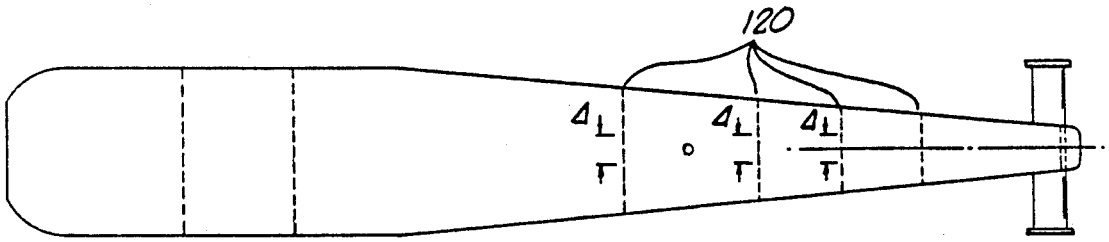
FIG. 6 is bottom view of the center hull of a marine vessel incorporating the present invention.
Figure 7:
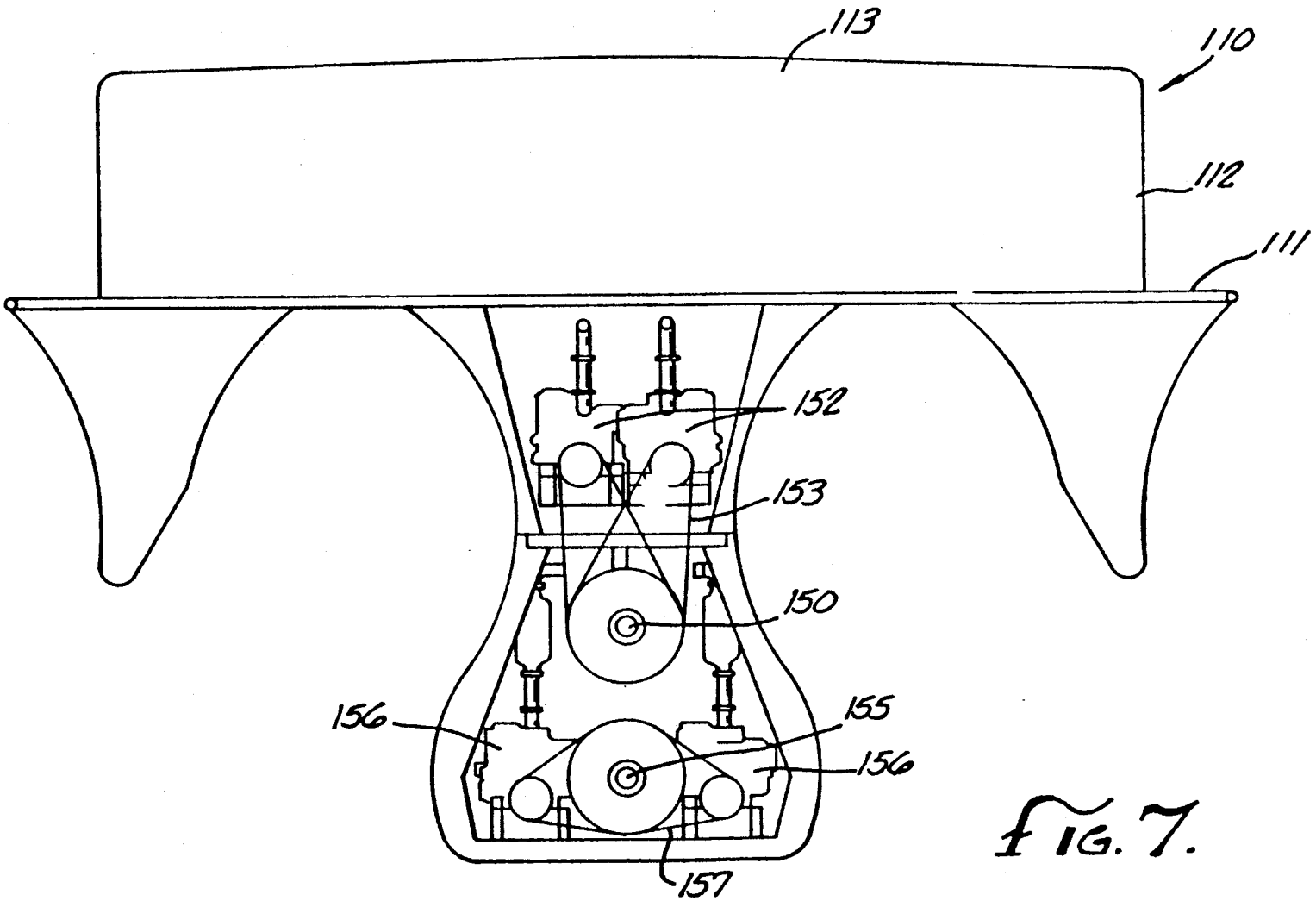
FIG. 7 is a cutaway aft end view of a marine vessel incorporating the present invention.

The bow closure 105 is achieved by using a frame 120 generated by the same circle arc contours $R_1$ and $R_2$ and cutting out an incremental vertical slice [delta symbol] from their middle as shown in FIG. 6. Thus, the decrease in width of the frames 120 by an incremental vertical slice [delta symbol] in the bow-ward direction generates a long bulbous bow that is streamlined and easily fabricated.

A starboard bow plane 130 and a port bow plane 131 are controlled by cables 132 and 133. The bow planes are fabricated in accordance with the teachings in my U.S. Letters Pat. Nos. 3,122,759, 3,204,699, 3,204,262 and 4,178,128 which are incorporated herein by reference in their entirety. The bow planes 130 and 131 share a common mounting shaft 134 about which the bow planes pivot. Both of the bow planes include a control plate 135 and 136 mounted on the bow planes close to the center hull 101. The control cables 132 and 133 are attached to the control plates in such a manner that tension on one of the control cables 132 will result in the bow planes moving to a positive attack angle whereas tension on the other control cable will result in the bow planes moving to a negative attack angle. This is accomplished by attaching one of the control cables at a point on the control plate above the centerline of the bow planes and one of the control cables at a point on the control plate below the centerline of the bow planes. The control cables are preferably controlled by hydraulic cylinders 137 and 138. In addition to providing exceptional control, this manner of arranging and controlling the bow planes also provides the unique feature of achieving propulsion in a seaway when there has been a catastrophic loss of power. The control of the bow planes 130 and 131 with the long flexible control cables 132 and 133 allows the bow planes to automatically flutter in a seaway as the ship pitches up and down and as the water flows by and over the bow planes. While this will only result in a minimal propulsive force, it will be sufficient propulsion to allow the ship to maintain enough forward movement to provide steerage, keeping the ship from being driven ashore. As one would imagine this would be of substantial benefit in the event of a power failure during a storm.

The stern 106 has a bluff afterbody contour. With this contour the flow field created by the propellers 140 and 141 draws great volumes of water around the afterbody in a streamlined manner as taught in my U.S. Letters Pat. No. 4,377,982, which is incorporated herein by reference in its entirety. Additionally this unique bluff contour dramatically increases the displacement aft providing room for the engines inside the center hull 101 in close proximity to the propellers. Having the engines in such close proximity to the propellers reduces the length and the diameter of the propeller shafts 150 and 151, thereby substantially reducing the weight of the propulsion system. Consequently the length of the ship can also be shortened while still maintaining the same cargo carrying capacity. As one might expect, this results in remarkable fuel economy during operation.

In the preferred embodiment the first propulsion means is comprised of a propeller 140, a propeller shroud 141 and a first drive means. The drive means is comprised of a shaft 150 which is coupled to a pair of engines 152 by drive belts 153. The propeller 140 is comprised of a plurality of blades 142 welded onto a large spherical hub 143. The spherical shape of the hub 143 provides additional streamlining to the propulsion system. The use of a propeller shroud 141, preferably a Kort nozzle, also adds to the streamlining of the system. The propeller should include a plurality of blades 142, preferably at least six and more preferably eight. The blades 142 are streamlined in cross section once again adding to the overall efficiency of the propulsion system.

The preferred embodiment includes a second propulsion means comprised of a propeller 145, a propeller shroud 147 and a second drive means. The second drive means is comprised of a shaft 155 which is coupled to a pair of engines 156 by drive belts 157. The propeller 145 is comprised of a plurality of blades 146 welded onto a large spherical hub 148. As with the first propulsion means, the spherical shape of the hub 148 provides additional streamlining to the propulsion system. Also the use of a propeller shroud 146, preferably a Kort nozzle, also adds to the streamlining of the system as with the first propulsion means. The propeller should include a plurality of blades 146, preferably at least six and more preferably eight. The blades 146 are streamlined in cross section once again adding to the overall efficiency of the propulsion system. In the preferred embodiment the second propulsion means includes a propeller 145 which is larger in diameter than the first propulsion means. This helps compensates for the longer frontal area of the center hull and greater beam at the water line of the second propulsion means.

The first propulsion means is mounted at the rear of the craft above the second propulsion means such that the centerlines of the first and second propulsion means are substantially aligned. This allows the first and second propulsion means to capture the entire or a large fraction thereof flow boundary layer of the center hull 101 in their flow field. A moveable rudder 160 is mounted substantially vertical at the rear of the craft along the centerline of and in the effluent streams of the first and second propulsion means. A fixed fin array 170 is also mounted at the rear of the craft in the effluent streams of the first and second propulsion means ahead of the rudder 160.

The fixed fin array 170 is comprised of a vertical fin 171 and a first and second horizontal fin 172 and 173. The vertical fin 171 is mounted substantially parallel to the rudder 160 between the first and second propulsion means and the rudder 160. The first horizontal fin 172 is mounted substantially perpendicular to the rudder 160 in the effluent stream of the first propulsion means. The second horizontal fin 173 is also mounted substantially perpendicular to the rudder, however it is mounted in the effluent stream of the second propulsion means.

This unique arrangement of the first and second propulsion means allows the purely stern driven craft to achieve lateral movement. In prior art propulsion systems this could only be accomplished by including a separately mounted marine thruster such as described in my U.S. Pat. No. 4,672,807, which is incorporated herein by reference in the craft's propulsion system. Lateral thrust at the stern can be generated with the propulsion system of the present invention by putting one of the two propulsion means "ahead" and the other of the two propulsion means "astern", that is that one would turn the propellers in a direction that would otherwise propel the craft forward and the other would turn the propellers in a direction that would otherwise propel the craft backward. With the two propulsion systems set to balance each other, i.e., the ahead propulsion means set to completely counteract the thrust of the astern propulsion means, and the rudder 160 set to port or starborad a pure lateral thrust will be generated in the direction set by the rudder 160.

Setting the propulsion means as indicated above will yield a pure lateral thrust because with the rudder 160 set to port or starboard a wash will flow over the rudder 160 from the ahead propulsion means which is directly laterally by the set of the rudder 160. The amount of lateral thrust can be infinitely varied by the set of the rudder 160. For example, if the rudder is set at zero degrees to port and starboard, i.e., straight ahead, the craft would remain dead in the water. The thrust from the ahead propulsion means would be completely counteracted by the thrust from the astern propulsion means. When the set of the rudder is changed this state of equilibrium will change. With the rudder set at 30 degrees maximum to port a lateral thrust will be generated by the ahead propulsion means. Since the direction of the effluent stream of the astern propulsion means is not changed by the change in the set of the rudder, this lateral thrust is not counteracted by the astern propulsion means. Thus, a lateral thrust is generated.

To assist in achieving and maintaining equal and opposite thrust from the two propulsion means, a Pitot tube survey rake 180 may be employed. The Pitot tube survey rake 180 is comprised of a series of nozzles 181 mounted along the edge of the fixed fin array 170 closest to the propulsion means in the effluent streams of the propulsion means. The nozzles are connected to tubes 182 that extend from the nozzles through the horizontal and vertical fins and into the craft where they are connected to a visual display board and if desired a computer that can monitor the flow at each of the nozzles. The computer can be used to directly control the speed of rotation of the propellers to provide complete and constant control.

To assist in maintaining a streamlined flow into the propulsion means and to ensure that the flow follows the contour of the bluff afterbody, turbulators 190 are attached to the center hull 101 just forward of the start of the stern contour. Additionally, hull fins 191 with a positive attack angle are attached to the center hull in substantially the same location to help ensure that the first propulsion means is not starved for fluid.

Thus, a propulsion system for inter alia providing high rough sea speeds and weathering capabilities while still providing a smooth ride, has been described. While embodiments, applications and advantages of the invention have been shown and described with sufficient clarity to enable one skilled in the art to make and use the invention, it would be equally apparent to those skilled in the art that many more embodiments, applications and advantages are possible without deviating from the inventive concepts disclosed and described herein. The invention therefore should only be restricted in accordance with the spirit of the claims appended hereto and is not to be restricted by the preferred embodiment, specification or drawings.

I claim as follows:

1. A watercraft comprising a large semi-submersible center hull and a first and second sponson positioned essentially parallel to and on opposite sides of said center hull, said center hull, said first sponson and said second sponson being held together in rigid alignment by means of a deck house; wherein said deck house is of a torsion box construction; and, said center hull having a flat bottom, a first and second side with circular contours and a long bulbous bow.

2. A watercraft as claimed in claim 1 further comprising a starboard and a port bow plane mounted on the sides of said long bulbous bow.

3. A watercraft as claimed in claim 2 wherein said bow planes are controlled by cables attached to a control plate mounted on said bow planes close to said long bulbous bow.

4. A watercraft as claimed in claim 2 wherein said bow planes are mounted on a common shaft.

5. A watercraft having a bow and a stern comprising a large semi-submersible center hull and a first and second sponson positioned essentially parallel to and on opposite sides of said center hull, said first and second sponsons being attached to said center hull by a rigid deck structure; said center hull having a flat bottom, a first and second side with circular contours and a long bulbous bow; said contour of said first and second sides having the same convex radius of curvature throughout the length of said long bulbous bow; said long bulbous bow being formed by incrementally decreasing the width of said flat bottom while maintaining a consistent radius of curvature for said side contours to obtain the bow closure.

6. A watercraft as claimed in claim 5 wherein said center hull further comprises a main portion extending from said long bulbous bow to said stern under said deck structure; said first and second sides of said main portion having a circular contour including a convex circular section contiguous with said flat bottom and a concave circular section attached to said deck structure wherein said radii of curvature of said convex circular section of said first and second sides are the same and said radii of curvature of said concave circular section of said first and second sides are the same.

7. A watercraft as claimed in claim 5 wherein said first and second sponsons include inner sides and outer sides, said inner sides being closest to said center hull, wherein said outer sides have a concave circular contour with the same radius of curvature and said inner sides have an upper section with a concave circular contour with the same radius of curvature and an angled lower section with a lower edge attached to a lower edge of said outer sides and an upper edge mating with a lower edge of said concave circular contour of said inner sides.

8. A watercraft as claimed in claim 5 further comprising a stern with a bluff afterbody contour.

9. A watercraft as claimed in claim 8 further comprising a propulsion system mounted at the stern of said centerhull including a first and second means for generating propulsion wherein said first and second means for generating propulsion are mounted in an over/under relationship with the centerlines of said propulsion means substantially aligned.

10. A watercraft as claimed in claim 8 further comprising turbulators mounted on said sides of said center hull just forward of said stern.

11. A watercraft as claimed in claim 8 further comprising hull fins mounted on said sides of said center hull just forward of said stern.

12. A watercraft as claimed in claim 5 further comprising a propulsion system mounted at the stern of said centerhull including a first and second means for generating propulsion wherein said first and second means for generating propulsion are mounted in an over/under relationship with the centerlines of said propulsion means substantially aligned.

13. A watercraft as claimed in claim 5 comprising a drive means and a propeller and a propeller nozzle; said propeller comprising a plurality of blades having a streamlined cross section affixed to an oblate spherical hub wherein said propeller is mounted concentrically within said propeller nozzle.

14. A watercraft as claimed in claim 5 further comprising turbulators mounted on said sides of said center hull just forward of said stern.

15. A watercraft as claimed in claim 5 further comprising hull fins mounted on said sides of said center hull just forward of said stern.

16. A watercraft as claimed in claim 5 further comprising a starboard and a port bow plane mounted on the sides of said long bulbous bow.

17. A watercraft having a bow and a stern comprising a center hull and a first and second sponson positioned essentially parallel to and on opposite sides of said center hull, said first and second sponson being connected to said center hull by a rigid deck plate; said center hull comprising a flat bottom and first and second sides with circular arc cross sections; said center hull having a long bulbous bow and a bluff afterbody contoured stern; and, bow planes mounted to said first and second sides of said center hull near said bow; said bow planes being controlled by means for allowing said planes to flutter as the watercraft pitches such that said bow planes provide minimal propulsion.

18. A watercraft of claim 17 further comprising a propulsion system mounted at the stern of said center hull including a first and second means for generating propulsion wherein said first and second means for generating propulsion are mounted in an over/under relationship with the centerlines of said propulsion means substantially aligned.

19. A watercraft as claimed in claim 17 wherein said bow plane control means comprises cables attached to a control plate mounted on said bow planes close to said long bulbous bow.

20. A watercraft as claimed in claim 17 further comprising turbulators mounted on said sides of said center hull.

21. A watercraft as claimed in claim 17 further comprising hull fins mounted on said sides of said center hull just forward of said stern.

22. A method of fabricating a watercraft comprising forming a hull such that the sides of the hull have cross sectional contours comprised solely of circle arcs;

forming a bow closure by using a frame generated by the same circle arc contours used to form the sides of the hull wherein the frame has a top and a bottom attaching the circle arc contours;

cutting out an incremental vertical slice from the top and bottom of the frame to form a second frame for use as the next frame closer to the bow;

cutting out an incremental vertical slice from the top and bottom of the second frame to form a third frame for use as the next frame closer to the bow; and, repeating the above steps of cutting out a vertical slice until bow closure is achieved.

* * * * *